US006740357B2

(12) United States Patent
Yamaguchi et al.

(10) Patent No.: US 6,740,357 B2
(45) Date of Patent: May 25, 2004

(54) WATER-AND OIL-REPELLENT TREATMENT OF TEXTILE

(75) Inventors: Fumihiko Yamaguchi, Settsu (JP); Ikuo Yamamoto, Settsu (JP); Kayo Kusumi, Settsu (JP)

(73) Assignee: Daikin Industries, Ltd., Osaka (JP)

( * ) Notice: Subject to any disclaimer, the term of this patent is extended or adjusted under 35 U.S.C. 154(b) by 0 days.

(21) Appl. No.: 10/327,190

(22) Filed: Dec. 24, 2002

(65) Prior Publication Data

US 2003/0157256 A1 Aug. 21, 2003

(30) Foreign Application Priority Data

Dec. 25, 2001 (JP) ..... P2001-391068

(51) Int. Cl.[7] ..... B05D 3/10

(52) U.S. Cl. ..... 427/352; 427/377; 427/387; 427/389.9; 427/393.4

(58) Field of Search ..... 427/352, 377, 427/387, 389.9, 393.4

(56) References Cited

U.S. PATENT DOCUMENTS 3,987,227 A * 10/1976 Schultz et al. ..... 428/91
4,962,156 A * 10/1990 Shinjo et al. ..... 525/100
5,073,442 A 12/1991 Knowlton
5,516,337 A 5/1996 Nguyen
5,520,962 A 5/1996 Jones, Jr.
5,851,595 A 12/1998 Jones, Jr.
6,472,019 B1 * 10/2002 Yamaguchi et al. ..... 427/354

FOREIGN PATENT DOCUMENTS

| | | |
|---|---|---|
| EP | 0435641 | 7/1991 |
| EP | 0984024 | 8/2000 |
| JP | 4-211489 | 8/1992 |
| JP | 2-60703 | 12/1993 |
| JP | 2000-144119 | 5/2000 |
| WO | WO 98/50619 | 11/1998 |

* cited by examiner

*Primary Examiner*—Erma Cameron
(74) *Attorney, Agent, or Firm*—Sughrue Mion, PLLC

(57) ABSTRACT

A method of preparing a treated textile, having steps of: (1) preparing a treatment liquid comprising a water- and oil-repellent agent, (2) adjusting pH of the treatment liquid to at most 7, (3) applying the treatment liquid to a textile, (4) treating the textile with steam, and (5) washing the textile with water and dehydrating the textile, wherein the water- and oil-repellent agent contains (A) a fluorine-containing compound which is a fluorine-containing polymer, and (B) a urethane compound and/or (C) a silicon-containing compound, can give a textile which is excellent in water repellency, oil repellency and soil releasability, when the textile is treated with the treatment liquid by an Exhaust process.

17 Claims, No Drawings

WATER-AND OIL-REPELLENT TREATMENT OF TEXTILE

FIELD OF THE INVENTION

The present invention relates to a treatment for imparting excellent water repellency, oil repellency and soil releasability to a textile. A method of the present invention is particularly useful for a carpet.

BACKGROUND OF THE INVENTION

Hitherto, various treatment methods have been proposed in order to impart water repellency, oil repellency and soil releasability to a textile such as a carpet. For example, a process (hereinafter, sometimes referred to as "Exhaust process") of treating a textile comprising decreasing a pH of a treatment liquid, applying the treatment liquid to the textile, thermally treating the textile with steam, washing the textile with water, and dehydrating the textile is proposed.

A method comprising the Exhaust process is proposed in U.S. Pat. Nos. 5,073,442, 5,520,962, 5,516,337 and 5,851,595 and International Publication WO 98/50619.

U.S. Pat. No. 5,073,442 discloses a method of treating a textile, comprising conducting an Exhaust process by using a water- and oil-repellent agent comprising a fluorine-containing compound, a formaldehyde condensation product and an acrylic polymer. U.S. Pat. Nos. 5,520,962 and 5,851,595 disclose a method of treating a carpet, comprising conducting an Exhaust process by using a fluorine-containing compound and a polymeric binder. U.S. Pat. No. 5,516,337 discloses a method of treating a textile, comprising conducting an Exhaust process by using a fluorine-containing water- and oil-repellent agent and a metal compound such as aluminum sulfate. International Publication WO 98/50619 discloses a method of treating a carpet, comprising conducting an Exhaust process by using a fluorine-containing water- and oil-repellent agent and a salt such as a magnesium salt.

JP-A-2000-144119 discloses a water-based soil release agent composition which comprises fine particles of a fluorine-containing copolymer comprising a (meth)acrylate having a polyfluoroalkyl group, an alkyl acrylate ester and a (meth)acrylate monoester of polyol, and a water-based medium. However, the use of the Exhaust process is not described, and a substrate treated with said water-based soil release agent composition is poor in water repellency, oil repellency and soil releasability.

Hitherto, a treatment agent satisfying both of excellent water- and oil-repellency and excellent soil releasability by using the Exhaust process could not be obtained.

SUMMARY OF THE INVENTION

An object of the present invention is to give a textile excellent in water repellency, oil repellency and soil releasability, when the textile is treated with a water- and oil-repellent agent by an Exhaust process.

The present invention provides a method of preparing a treated textile, comprising steps of:

(1) preparing a treatment liquid comprising a water- and oil-repellent agent,
(2) adjusting pH of the treatment liquid to at most 7,
(3) applying the treatment liquid to a textile,
(4) treating the textile with steam, and
(5) washing the textile with water and dehydrating the textile, wherein the water- and oil-repellent agent comprises (A) a fluorine-containing compound which is a fluorine-containing polymer, and (B) a urethane compound and/or (C) a silicon-containing compound.

The present invention also provides a textile prepared by the above-mentioned method and a water- and oil-repellent agent used in the above-mentioned method.

DETAILED DESCRIPTION OF THE INVENTION

The procedure used in the present invention is an Exhaust process which comprises decreasing pH of a treatment liquid comprising a fluorine-containing compound, applying a treatment liquid to a textile, thermally treating the textile, washing the textile with water, and dehydrating the textile.

In the step (1) of the method of the present invention, the treatment liquid comprising the water- and oil-repellent agent, which is applied to the textile, is prepared. The treatment liquid comprising the water- and oil-repellent agent may be in the form of a solution or an emulsion, particularly an aqueous emulsion.

In the step (2) in the method of the present invention, pH of the treatment liquid is brought to at most 7. pH of the treatment liquid is, for example, at most 5, e.g., at most 4, particularly at most 3, especially at most 2. pH can be decreased by addition of an acid such as an aqueous solution of citraconic acid and an aqueous solution of sulfamic acid to the treatment liquid.

In the step (3) of the method of the present invention, the treatment liquid is applied to the textile. The water- and oil-repellent agent can be applied to a substrate to be treated (that is, the textile) by a know procedure. The application of the treatment liquid can be conducted by immersion, spraying and coating. Usually, the treatment liquid is diluted with an organic solvent or water, and is adhered to surfaces of the substrate by a well-known procedure such as an immersion coating, a spray coating and a foam coating to a fabric (for example, a carpet cloth), a yarn (for example, a carpet yarn) or an original fiber. If necessary, the treatment liquid is applied together with a suitable crosslinking agent, followed by curing. It is also possible to add mothproofing agents, softeners, antimicrobial agents, flame retardants, antistatic agents, paint fixing agents, crease-proofing agents, etc. to the treatment liquid. The concentration of the water- and oil-repellent agent active component (that is, the fluorine-containing compound) in the treatment liquid contacted with the substrate may be from 0.01 to 10% by weight, for example, from 0.05 to 10% by weight, based on the treatment liquid. A stain blocking agent may used in the amount of, for example, 0 to 1,000 parts by weight, particularly 1 to 500 parts by weight, in terms of solid, per 100 parts by weight of the fluorine-containing compound.

In the step (4) of the method of the present invention, the textile is thermally treated. The thermal treatment can be conducted by applying a steam (for example, 90 to 110° C.) to the textile under a normal pressure for e.g., 10 seconds to 10 minutes.

In the step (5) of the method of the present invention, the textile is washed with water and dehydrated. The thermally treated textile is washed with water at least once. Then, in order to remove excess water, the textile is dehydrated by a usual dehydration procedure such as a centrifuging and vacuuming procedure.

After the step (5), the textile can be dried.

The fluorine-containing compound is a fluorine-containing polymer.

The fluorine-containing polymer may be a polymer comprising a repeat unit derived from a fluoroalkyl group-containing monomer such as a fluoroalkyl group-containing (meth)acrylate, a fluoroalkyl group-containing maleate or fumarate, or a fluoroalkyl group-containing urethane.

The fluoroalkyl group-containing (meth)acrylate ester may be of the formula:

$$Rf—A—OCOCR^{11}=CH_2$$

wherein Rf is a fluoroalkyl group having 3 to 21 carbon atoms, $R^{11}$ is a hydrogen atom or a methyl group, and A is a divalent organic group.

In the above formula, A may be a linear or branched alkylene group having 1 to 20 carbon atoms, a $—SO_2N(R^{21})R^{22}—$ group or a $—CH_2CH(OR^{23})CH_2—$ group ($R^{21}$ is an alkyl group having 1 to 10 carbon atoms, $R^{22}$ is a linear or branched alkylene group having 1 to 10 carbon atoms, and $R^{23}$ is a hydrogen atom or an acyl group having 1 to 10 carbon atoms).

Examples of the fluoroalkyl group-containing (meth) acrylate are as follows:

$$Rf—SO_2—\overset{\overset{R^1}{|}}{N}R^2OCOCR^3=CH_2 \quad (1)$$

$$Rf—(CH_2)_nOCOCR^3=CH_2 \quad (2)$$

$$Rf—\overset{\overset{R^1}{|}}{C}ONR^2OCOCR^3=CH_2 \quad (3)$$

$$Rf—CH_2\overset{\overset{OH}{|}}{C}HCH_2OCOCR^3=CH_2 \quad (4)$$

$$Rf—CH_2\overset{\overset{OCOR^3}{|}}{C}HCH_2OCOCR^3=CH_2 \quad (5)$$

$$Rf—O—Ar—CH_2OCOCR^3=CH_2 \quad (6)$$

wherein Rf is a fluoroalkyl group having 3 to 21 carbon atoms, $R^1$ is a hydrogen atom or an alkyl group having 1 to 10 carbon atoms, $R^2$ is an alkylene group having 1 to 10 carbon atoms, $R^3$ is a hydrogen atom or a methyl group, and Ar is arylene group optionally having a substituent, and n is an integer of 1 to 10.

Specific examples of the fluoroalkyl group-containing (meth)acrylate are as follows:

$CF_3(CF_2)_7(CH_2)_{10}OCOCH=CH_2$
$CF_3(CF_2)_7(CH_2)_{10}OCOC(CH_3)=CH_2$
$CF_3(CF_2)_6CH_2OCOCH=CH_2$
$CF_3(CF_2)_8CH_2OCOC(CH_3)=CH_2$
$(CF_3)_2CF(CF_2)_6(CH_2)_2OCOCH=CH_2$
$(CF_3)_2CF(CF_2)_8(CH_2)_2OCOCH=CH_2$
$(CF_3)_2CF(CF_2)_{10}(CH_2)_2OCOCH=CH_2$
$(CF_3)_2CF(CF_2)_6(CH_2)_2OCOC(CH_3)=CH_2$
$(CF_3)_2CF(CF_2)_8(CH_2)_2OCOC(CH_3)=CH_2$
$(CF_3)_2CF(CF_2)_{10}(CH_2)_2OCOC(CH_3)=CH_2$
$CF_3CF_2(CF_2)_6(CH_2)_2OCOCH=CH_2$
$CF_3CF_2(CF_2)_8(CH_2)_2OCOCH=CH_2$
$CF_3CF_2(CF_2)_{10}(CH_2)_2OCOCH=CH_2$
$CF_3CF_2(CF_2)_6(CH_2)_2OCOC(CH_3)=CH_2$
$CF_3CF_2(CF_2)_8(CH_2)_2OCOC(CH_3)=CH_2$
$CF_3CF_2(CF_2)_{10}(CH_2)_2OCOC(CH_3)=CH_2$
$CF_3(CF_2)_7SO_2N(CH_3)(CH_2)_2OCOCH=CH_2$
$CF_3(CF_2)_7SO_2N(C_2H_5)(CH_2)_2OCOCH=CH_2$
$(CF_3)_2CF(CF_2)_8CH_2CH(OCOCH_3)CH_2OCOC(CH_3)=CH_2$
$(CF_3)_2CF(CF_2)_6CH_2CH(OH)CH_2OCOCH=CH_2$

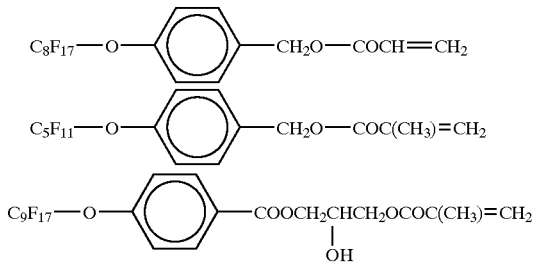

The fluorine-containing polymer constituting the water- and oil-repellent agent may comprise:

(I) a repeat unit derived from a monomer having a fluoroalkyl group, and (II) a repeat unit derived from a fluorine-free monomer.

The fluorine-containing polymer constituting the water- and oil-repellent agent may comprise:

(I) a repeat unit derived from a monomer having a fluoroalkyl group, (II) a repeat unit derived from a fluorine-free monomer, and (III) a repeat unit derived from a crosslinkable monomer.

Examples of the monomer having fluoroalkyl group constituting the repeat unit (I) include the same as the above-mentioned fluoroalkyl group-containing monomer such as a fluoroalkyl group-containing (meth)acrylate.

The repeat unit (II) is preferably derived from a fluorine-free olefinically unsaturated monomer.

An example of the repeat unit (II) is one derived from olefinically unsaturated monomer of the formula (II-A):

$$CH_2=CR^{21}C(=O)—O—CH_2—CR^{22}H—R^{23} \quad (II\text{-}A)$$

or the formula (II-B):

$$CH_2=CR^{21}C(=O)—O—R^{23} \quad (II\text{-}B)$$

wherein $R^{21}$ is $CH_3$ or H, $R^{22}$ is $CH_3$ or $C_2H_5$, and $R^{23}$ is $C_nH_{2n+1}$ (n=1 to 30, particularly 1 to 6).

In the fluorine-containing polymer, the amount of the repeat unit (II-A) is from 5 to 75 parts by weight and the amount of (II-B) is from 0 to 50, based on 100 parts by weight of the repeat unit (I).

Non-limiting examples of a preferable monomer constituting the repeat unit (II) include, for example, ethylene, vinyl acetate, vinyl halide such as vinyl chloride, vinylidene halide such as vinylidene chloride, acrylonitrile, styrene, polyethyleneglycol (meth)acrylate, polypropyleneglycol (meth)acrylate, methoxypolyethyleneglycol (meth)acrylate, methoxypolypropyleneglycol (meth)acrylate, vinyl alkyl ether and isoprene.

The monomer constituting the repeat unit (II) may be a (meth)acrylate ester having an alkyl group. The number of carbon atoms of the alkyl group may be from 1 to 30, for example, from 6 to 30, e.g., from 10 to 30. For example, the monomer constituting the repeat unit (II) may be acrylates of the general formula:

$$CH_2=CA^3COOA^4$$

wherein $A^3$ is a hydrogen atom or a methyl group, and $A^4$ is an alkyl group represented by $C_nH_{2n+1}$ (n=1 to 30). The copolymerization with this monomer can optionally improve various properties such as water repellency and soil releasability; cleaning durability, washing durability and abrasion resistance of said repellency and releasability; solubility in solvent; hardness; and feeling.

The crosslinkable monomer constituting the repeat unit (III) may be a fluorine-free vinyl monomer having at least two reactive groups. The crosslinkable monomer may be a compound having at least two carbon-carbon double bonds, or a compound having at least one carbon-carbon double bond and at least one reactive group.

Examples of the crosslinkable monomer include diacetoneacrylamide, (meth)acrylamide, N-methylolacrylamide, hydroxymethyl (meth)acrylate, hydroxyethyl (meth)acrylate, 3-chloro-2-hydroxypropyl (meth)acrylate, N,N-dimethylaminoethyl (meth)acrylate, N,N-diethylaminoethyl (meth)acrylate, butadiene, chloroprene and glycidyl (meth)acrylate, to which the crosslinkable monomer is not limited. The copolymerization with this monomer can optionally improve various properties such as water repellency and soil releasability; cleaning durability and washing durability of said repellency and releasability; solubility in solvent; hardness; and feeling.

The fluorine-containing polymer may have a weight-average molecular weight of 2,000 to 5,000,000, particularly 3,000 to 5,000,000, especially 10,000 to 1,000,000.

Preferably, in the fluorine-containing polymer, the amount of the repeat unit (II) is from 0 to 80 parts by weight, more preferably from 0 to 60 parts by weight, for example, from 0.5 to 50 parts by weight, and the amount of the repeat unit (III) is from 0 to 30 parts by weight, more preferably from 0.5 to 15 parts by weight, for example, from 0.5 to 10 parts by weight, based on 100 parts by weight of the repeat unit (I).

The fluorine-containing polymer in the present invention can be produced by any polymerization method, and the conditions of the polymerization reaction can be arbitrary selected. The polymerization method includes, for example, solution polymerization and emulsion polymerization. Among them, the emulsion polymerization is particularly preferred.

In the solution polymerization, there can be used a method of dissolving monomers into an organic solvent in the presence of a polymerization initiator, replacing the atmosphere by nitrogen, and stirring the mixture with heating, for example, at the temperature within the range from 50° C. to 120° C. for 1 hour to 10 hours. Examples of the polymerization initiator include azobisisobutyronitrile, benzoyl peroxide, di-tert-butyl peroxide, lauryl peroxide, cumene hydroperoxide, t-butyl peroxypivalate and diisopropyl peroxydicarbonate. The polymerization initiator may be used in the amount within the range from 0.01 to 5 parts by weight based on 100 parts by weight of the monomers.

The organic solvent is inert to the monomer and dissolves the monomer, and examples thereof include pentane, hexane, heptane, octane, cyclohexane, benzene, toluene, xylene, petroleum ether, tetrahydrofuran, 1,4-dioxane, methyl ethyl ketone, methyl isobutyl ketone, ethyl acetate, butyl acetate, 1,1,2,2-tetrachloroethane, 1,1,1-trichloroethane, trichloroethylene, perchloroethylene, tetrachlorodifluoroethane and trichlorotrifluoroethane. The organic solvent may be used in the amount within the range from 50 to 1,000 parts by weight based on 100 parts by weight of total of the monomers.

In the emulsion polymerization, there can be used a method of emulsifying monomers in water in the presence of a polymerization initiator and an emulsifying agent, replacing the atmosphere by nitrogen, and copolymerizing with stirring, for example, at the temperature within the range from 50° C. to 80° C. for 1 hour to 10 hours. As the polymerization initiator, for example, water-soluble initiators (e.g., benzoyl peroxide, lauroyl peroxide, t-butyl perbenzoate, 1-hydroxycyclohexyl hydroperoxide, 3-carboxypropionyl peroxide, acetyl peroxide, azobisisobutylamidine dihydrochloride, azobisisobutyronitrile, sodium peroxide, potassium persulfate and ammonium persulfate) and oil-soluble initiators (e.g., azobisisobutyronitrile, benzoyl peroxide, di-tert-butyl peroxide, lauryl peroxide, cumene hydroperoxide, t-butyl peroxypivalate and diisopropyl peroxydicarbonate) are used. The polymerization initiator may be used in the amount within the range from 0.01 to 5 parts by weight based on 100 parts by weight of the monomers.

In order to obtain a copolymer dispersion in water, which is superior in storage stability, it is desirable that the monomers are atomized in water by using an emulsifying device capable of applying a strong shattering energy (e.g., a high-pressure homogenizer and an ultrasonic homogenizer) and then polymerized with using the oil-soluble polymerization initiator. As the emulsifying agent, various emulsifying agents such as an anionic emulsifying agent, a cationic emulsifying agent and a nonionic emulsifying agent can be used in the amount within the range from 0.5 to 10 parts by weight based on 100 parts by weight of the monomers. When the monomers are not completely compatibilized, a compatibilizing agent capable of sufficiently compatibilizing them (e.g., a water-soluble organic solvent and a low-molecular weight monomer) is preferably added to these monomers. By the addition of the compatibilizing agent, the emulsifiability and copolymerizability can be improved.

Examples of the water-soluble organic solvent include acetone, methyl ethyl ketone, ethyl acetate, propylene glycol, dipropylene glycol monomethyl ether, dipropylene glycol, tripropylene glycol and ethanol. The water-soluble organic solvent may be used in the amount within the range from 1 to 50 parts by weight, e.g., from 10 to 40 parts by weight, based on 100 parts by weight of water.

The amount of the fluorine-containing compound may be at most 80% by weight, particularly from 1 to 60% by weight, based on the water- and oil-repellent agent. The amount of the emulsifying agent may be from 0.5 to 15 parts by weight, based on 100 parts by weight of the fluorine-containing compound.

The urethane compound (B) is a low molecular weight compound having at least one urethane group. The number of urethane groups in the urethane compound is, for example, 1 to 10, particularly from 2 to 4. The molecular weight of the urethane compound (B) is, for example, from 500 to 4,000, particularly from 2,000 to 3,000.

The urethane compound (B) is, for example, a compound of the formula:

$$(Rf'\text{—}CO\text{—}NH)_a X(NH\text{—}CO\text{—}R')_b$$

wherein Rf' is a monovalent organic group having at least one fluorine atom,

X is an organic group having a valency of (a+b) remaining after all isocyanate groups are removed from an isocyanate compound having (a+b) isocyanate groups, R' is a monovalent organic group free of a fluorine atom, and a is an integer of 0 to 10, b is an integer of from 0 to 10, and the total of a and b is an integer of 1 to 15.

The number a may be, for example, from 0 to 4, particularly from 0 to 2. The number b may be, for example, from 0 to 4, particularly from 0 to 2. The total of the numbers a and b may be, for example, from 1 to 10, particularly from 1 to 5, especially from 2 to 4.

The Rf' group may be, for example, a group:

$$Rf—A^1—B^1—$$

wherein Rf is a fluoroalkyl group (particularly perfluoroalkyl group) having 3 to 21 carbon atoms, $A^1$ is $—SO_2—N(R^{11})—R^{12}—$, $—(CH_2)_n—$, $—CO—N(R^{11})—$, $—CH_2C(OH)HCH_2—$, $—CH_2C(OCOR^{13})HCH_2—$, or $—O—Ar—CH_2—$ (in which $R^{11}$ is a hydrogen atom or an alkyl group having 1 to 10 carbon atoms, $R^{12}$ is alkylene group having 1 to 10 carbon atoms, $R^{13}$ is a hydrogen atom or a methyl group, and Ar is an arylene group optionally having a substituent), and $B^1$ is —O—, —S— or $—N(R^{21})—$ (in which $R^{21}$ is a hydrogen atom or an alkyl group having 1 to 10 carbon atoms).

The R' group may be, for example, a group:

$$—B^2—A^2$$

wherein $B^2$ is —O—, —S— or $—N(R^{21})—$ (in which $R^{21}$ is a hydrogen atom or an alkyl group having 1 to 10 carbon atoms), and $A^2$ is an optionally substituted alkyl group having 1 to 30 carbon atoms (for example, a stearyl group).

The urethane compound (B) is, for example, a compound of the formula:

$$(Rf—A^1—B^1—CO—NH)_aX\ (NHCO—B^2—A^2)_b$$

wherein each of Rf, $A^1$, $B^1$, X, $B^2$ and $A^2$ is independently the same as the above, and a and b are the same as the above.

Specific examples of the urethane compound (B) are as follows.

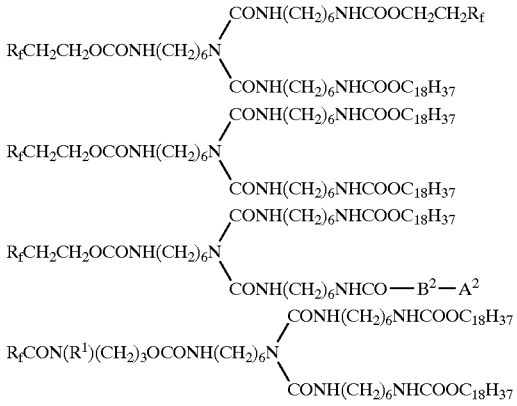

-continued

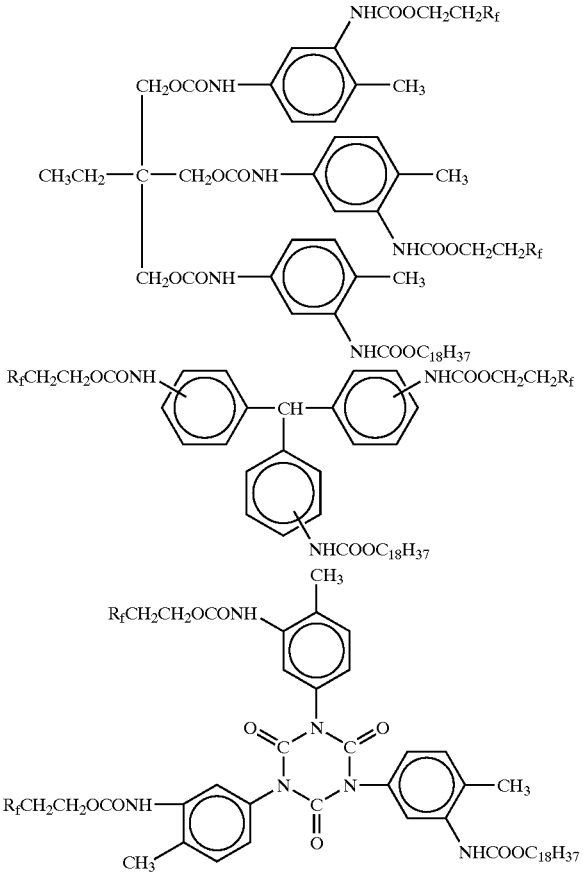

wherein Rf, $A^2$ and $B^2$ are the same as the above.

The urethane compound (B) can be obtained by reacting an isocyanate compound with an isocyanate-reactive compound. The isocyanate-reactive compound is, for example, a compound having at least one (particularly one) hydroxyl group, amino group or epoxy group.

The isocyanate compound may be a compound of the formula:

$$X(NCO)_{a+b},$$

and the isocyanate-reactive compound may be a compound of the formula:

$$Rf—A^1—B^1—H$$

(a fluorine-containing isocyanate-reactive compound) and/or $$H—B^2—A^2$$

(a fluorine-free isocyanate-reactive compound)

wherein Rf, $A^1$, $B^1$, X, $B^2$, $A^2$, a and b are the same as the above.

Examples of the isocyanate compound are as follows:

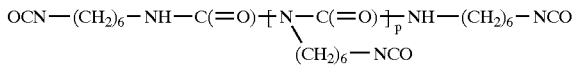

(that is, a homopolymer of hexamethylene diisocyanate) (p is a number of 0 to 10.),

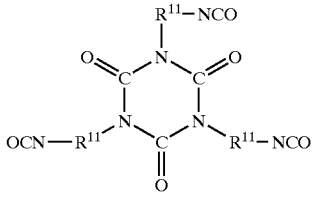

wherein $R^{11}$ is divalent aliphatic, cycloaliphatic, aromatic or araliphatic hydrocarbon group (having, for example, 1 to 20 carbon atoms, particularly 1 to 10 carbon atoms).

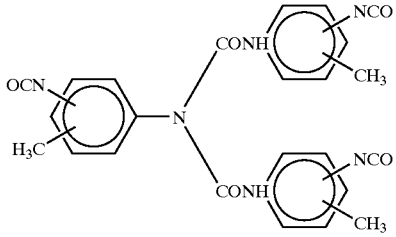

Specific examples of the fluorine-containing isocyanate-reactive compound having one hydroxyl group, amino group or epoxy group is as follows:

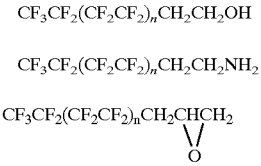

[n=2 to 8]

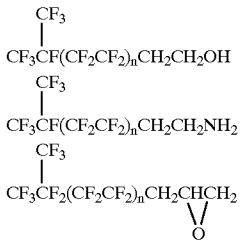

[n=2 to 8]

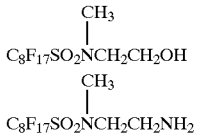

-continued

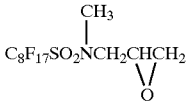

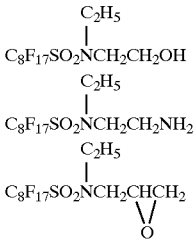

Specific examples of the fluorine-free isocyanate-reactive compound are as follows:

$R^{41}$—OH $R^{42}$—$NH_2$

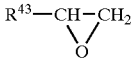

wherein $R^{41}$, $R^{42}$ and $R^{43}$ are an alkyl group having 1 to 22 carbon atoms.

Specific examples of the silicon-containing compound (C) are as follows:

Silicone Oils

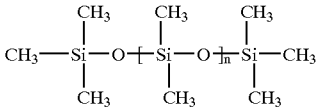

wherein n is an integer of 1 to 100,000,

Modified Silicones

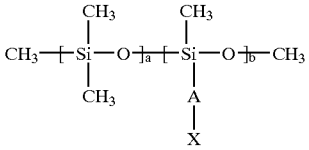

wherein A is a direct bond or an alkylene group having 1 to 20 carbon atoms, X is an epoxy group, an amine group, a carboxyl group, an aryl group or a hydroxyl group, and a and b is an integer of 1 to 100,000, and Silicone Resin

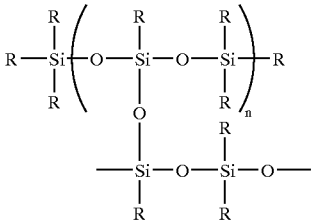

wherein R is an aliphatic hydrocarbon group (for example, a methyl group) or an aromatic hydrocarbon group (for example, an aryl group), and n is an integer of 1 to 100,000.

The total amount of the urethane compound (B) and the silicon-containing (C) may be, for example, from 1 to 30% by weight, particularly from 1 to 20% by weight, based on the water- and oil-repellent agent.

The substrate to be treated in the present invention is preferably a textile, particularly a carpet. The textile includes various examples. Examples of the textile include animal- or vegetable-origin natural fibers such as cotton, hemp, wool and silk; synthetic fibers such as polyamide, polyester, polyvinyl alcohol, polyacrylonitrile, polyvinyl chloride and polypropylene; semisynthetic fibers such as rayon and acetate; inorganic fibers such as glass fiber, carbon fiber and asbestos fiber; and a mixture of these fibers. The present invention can be suitably used in carpets made of nylon fibers, polypropylene fibers and/or polyester fibers, because the present invention provides excellent resistance to a detergent solution and brushing (mechanical).

The textile may be in any form such as a fiber and a fabric. When the carpet is treated according to the present invention, the carpet may be formed after the fibers or yarns are treated with the water- and oil-repellent agent, or the formed carpet may be treated with the water- and oil-repellent agent. The water- and oil-repellent agent can be used under the state that the fluorine-containing compound is diluted to 0.02% to 30% by weight, preferably 0.02% to 10% by weight.

EXAMPLES

The following Examples further illustrate the present invention in detail but are not to be construed to limit the scope thereof. In the Examples, % is % by weight unless otherwise specified. The water repellency, oil repellency and soil releasability of the carpets obtained in the Examples and Comparative Examples were evaluated.

Test procedures of the water repellency, the oil repellency and the soil releasability are as follows.

Water Repellency

A carpet treated with a water- and oil-repellent agent is stored in a thermo-hygrostat having a temperature of 21° C. and a humidity of 65% for at least 4 hours. A test liquid (isopropyl alcohol (IPA), water and a mixture thereof, as shown in Table 1) which has been also stored at 21° C. is used. The test is conducted in a room having a constant temperature of 21° C. and a constant humidity of 65%. Five Droplets (one drop has an amount of 50 $\mu$L) of the test liquid are softly dropped by a micropipette on the carpet. If 4 or 5 droplets remain on the carpet after standing for 10 seconds, it is evaluated that the test liquid passes the test. A point corresponding to the maximum content of isopropyl alcohol (IPA) (% by volume) in the test liquid which passes the test is taken as the result of the water repellency. The evaluation is conducted at 12 levels of Fail, 0, 1, 2, 3, 4, 5, 6, 7, 8, 9, 10 in order of bad water repellency to excellent water repellency.

TABLE 1

| Water repellency test liquid | | |
|---|---|---|
| | (Volume ratio %) | |
| Point | Isopropyl alcohol | Water |
| 10 | 100 | 0 |
| 9 | 90 | 10 |
| 8 | 80 | 20 |
| 7 | 70 | 30 |

TABLE 1-continued

| Water repellency test liquid | | |
|---|---|---|
| | (Volume ratio %) | |
| Point | Isopropyl alcohol | Water |
| 6 | 60 | 40 |
| 5 | 50 | 50 |
| 4 | 40 | 60 |
| 3 | 30 | 70 |
| 2 | 20 | 80 |
| 1 | 10 | 90 |
| 0 | 0 | 100 |
| Fail | Inferior to isopropyl alcohol 0/water 100 | |

Oil Repellency

A carpet treated with a water- and oil-repellent agent is stored in a thermo-hygrostat having a temperature of 21° C. and a humidity of 65% for at least 4 hours. A test liquid (shown in Table 2) which has been also stored at 21° C. is used. The test is conducted in a room having a constant temperature of 21° C. and a constant humidity of 65%. Five Droplets (one drop has an amount of 50 $\mu$L) of the test liquid are softly dropped by a micropipette on the carpet. If 4 or 5 droplets remain on the carpet after standing for 30 seconds, it is evaluated that the test liquid passes the test. A maximum point of the test liquid which passes the test is taken as the result of the water repellency. The evaluation is conducted at 9 levels of Fail, 1, 2, 3, 4, 5, 6, 7, 8 in order of bad oil repellency to excellent oil repellency.

TABLE 2

| Oil repellency test liquid | | |
|---|---|---|
| Point | Test liquid | Surface tension (dyne/cm, 25° C.) |
| 8 | n-Heptane | 20.0 |
| 7 | n-Octane | 21.8 |
| 6 | n-Decane | 23.5 |
| 5 | n-Dodecane | 25.0 |
| 4 | n-Tetradecane | 26.7 |
| 3 | n-Hexadecane | 27.3 |
| 2 | Mixture liquid of n-hexadecane 35/Nujol 65 | 29.6 |
| 1 | Nujol | 31.2 |
| Fail | Inferior to 1 | — |

Stain Releasability Test

The stain releasability test is conducted according to AATCC Test Method 123-1989.

The soil releasability is evaluated at 9 levels of 1, 1-2, 2, 2-3, 3, 3-4, 4, 4-5 and 5 from remarkable discoloration to no discoloration by comparing a carpet sample before and after the stain releasability test by using a gray scale for discoloration.

Preparative Example 1

120 g of $CH_2{=}CHCOO(CH_2)_2(CF_2CF_2)_nCF_2CF_3$ (a mixture of compounds wherein n is 3, 4 and 5 in a weight ratio of 5:3:1) (FA), 30 g of stearyl acrylate (StA), 30 g of 2-hydroxyethyl methacrylate (2EHA), 3.9 g of glycidyl methacrylate (BLEMER G manufactured by NFO Corp.), 4.5 g of N-methylol acrylamide (N-MAM), 2.1 g of 3-chloro-2-hydroxypropyl methacrylate (TOPOLENE M manufactured by Shin-Nakamura Chemical Co., Ltd.), 340 g of deionized water, 0.3 g of n-laurylmercaptan (LSH), 8.4 g of ammonium polyoxyethylenealkylphenyl ether sulfate (HYTENOL N-17 manufactured by produced by Dai-ichi Kogyo Seiyaku Co., Ltd., an anionic emulsifying agent), 2.7 g of polyoxyethylenealkylphenyl ether (NONION HS-220 manufactured by NOF Corp., a nonionic emulsifying agent), 3.6 g of sorbitan monolaurate (LP-20R manufactured by NOF Corp., a nonionic emulsifying agent) and 37.5 g of dipropyleneglycolmonomethylether (DPM) were mixed to give a mixture liquid.

The mixture liquid was heated to 60° C. and homogenized by a high pressure homogenizer. The resultant emulsion liquid was charged into 1 L autoclave which was replaced with nitrogen to remove off the dissolved oxygen. Then, as the initiator, 0.9 g of ammonium persulfate (APS) and 0.2 g of sodium pyrosulfate were charged. The copolymerization was conducted at 60° C. for 8 hours to give a fluorine-containing copolymer emulsion. Then the copolymer emulsion was diluted with water to give an emulsion having a solid content of 30% by weight.

Comparative Example 1

Water was added for the dilution to 0.5 g or 1 g of the emulsion prepared in Preparative Example 1 and 5 g of a stain blocking agent A [a mixture of phenol/formaldehyde condensate and polymethacrylic acid (weight ratio: 1:1)], to give the total amount of 1,000 g. A 10% solution of sulfamic acid was added to the diluted emulsion so that the diluted emulsion had a pH of 1.5, to give a treatment liquid. The fluorine concentration on a carpet treated with the treatment liquid were 150 ppm and 300 ppm, respectively.

A carpet (20 cm×20 cm, nylon-6, cut pile, density: 32 oz/yd$^2$) was washed with water and was squeezed to have a WPU of 25% (WPU: wet pick up, WPU is 25% when 25 g of a liquid is contained in 100 g of the carpet). This carpet was immersed in the treatment liquid for 30 seconds and squeezed to have a WPU (wet pick up) amount of 300%. Then, a normal-pressure steamer treatment (temperature: 100° C. to 107° C.) was conducted for 90 seconds under the state that a pile surface of the carpet was upside. The carpet was rinsed with 10 L of water and then centrifugal dehydration was conducted to give a WPU amount of 25%. Finally, the carpet was thermally cured at 110° C. for 10 minutes.

Then, the water repellency test, the oil repellency test and the soil releasability test were conducted. The results are shown in Table 3.

Comparative Example 2

Water was added for the dilution to 1 g of an emulsion of urethane 1 [an aqueous dispersion of a reaction mixture of a biuret-type trifunctional isocyanate of the formula:

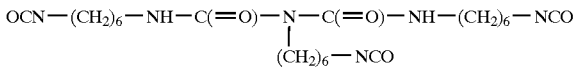

and Rf alcohol of the formula:

$CF_3CF_2\ (CF_2CF_2)_nCH_2CH_2OH$ (n=3, 4, 5, 6 and 7), in which a urethane content is 10% by weight], and 5 g of the stain blocking agent A to give the total amount of 1,000 g. A 10% solution of sulfamic acid was added to the diluted liquid so that the diluted liquid had a pH of 1.5, to give a treatment liquid. A carpet was treated with the treatment liquid as in Comparative Example 1.

Then, the water repellency test, the oil repellency test and the soil releasability test were conducted. The results are shown in Table 3.

Example 1

Water was added for the dilution to 0.5 g or 1 g of the emulsion prepared in Preparative Example 1, 1 g of the emulsion of urethane 1 and 5 g of the stain blocking agent A to give the total amount of 1,000 g. A 10% solution of sulfamic acid was added to the diluted liquid so that the diluted liquid had a pH of 1.5, to give a treatment liquid. A carpet was treated with the treatment liquid as in Comparative Example 1.

Then, the water repellency test, the oil repellency test and the soil releasability test were conducted. The results are shown in Table 3.

Comparative Example 3

Water was added for the dilution to 1 g of an emulsion of urethane 2 [an aqueous dispersion of a reaction mixture of a isocyanurate-type trifunctional isocyanate of the formula:

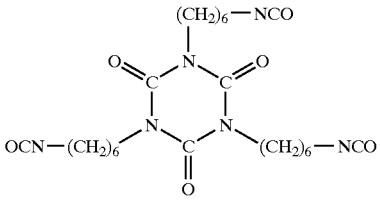

and Rf alcohol of the formula:

$CF_3CF_2(CF_2CF_2)_nCH_2CH_2OH$ (n=3, 4, 5, 6 and 7)

in which a urethane content is 10% by weight], and 5 g of the stain blocking agent A to give the total amount of 1,000 g. A 10% solution of sulfamic acid was added to the diluted liquid so that the diluted liquid had a pH of 1.5, to give a treatment liquid. A carpet was treated with the treatment liquid as in Comparative Example 1.

Then, the water repellency test, the oil repellency test and the soil releasability test were conducted. The results are shown in Table 3.

Example 2

Water was added for the dilution to 0.5 g or 1 g of the emulsion prepared in Preparative Example 1, 1 g of the emulsion of urethane 2 and 5 g of the stain blocking agent A to give the total amount of 1,000 g. A 10% solution of sulfamic acid was added to the diluted liquid so that the diluted liquid had a pH of 1.5, to give a treatment liquid. A carpet was treated with the treatment liquid as in Comparative Example 1.

Then, the water repellency test, the oil repellency test and the soil releasability test were conducted. The results are shown in Table 3.

TABLE 3

| | Urethane | Preparative Example 1 (ppm) | Water repellency | Oil repellency | Soil releasability |
|---|---|---|---|---|---|
| Com. | — | 150 | 3 | 3 | 2 |
| Ex. 1 | — | 300 | 10 | 5 | 2 |
| Com. Ex. 2 | Urethane 1 | 0 | 2 | 2 | 4 |
| Ex. 1 | Urethane 1 | 150 | 5 | 3 | 4 |
| | | 300 | 9 | 5 | 4 |

TABLE 3-continued

| | Urethane | Preparative Example 1 (ppm) | Water repellency | Oil repellency | Soil releasability |
|---|---|---|---|---|---|
| Com. Ex. 3 | Urethane 2 | 0 | 1.5 | 4 | 4 |
| Ex. 2 | Urethane 2 | 150 | 3 | 5 | 4 |
| | | 300 | 6 | 6 | 4 |

Effects of the Invention

According to the present invention, the Exhaust process can give a textile which is excellent in water repellency, oil repellency and soil releasability.

What is claimed is:

1. A method of preparing a treated textile, comprising steps of:

(1) preparing a treatment liquid comprising a water- and oil-repellent agent, (2) adjusting pH of the treatment liquid to at most 7, (3) applying the treatment liquid to a textile, (4) treating the textile with steam, and (5) washing the textile with water and dehydrating the textile, wherein the water- and oil-repellent agent comprises (A) a fluorine-containing compound which is a fluorine-containing polymer and (B) a urethane compound, wherein the fluorine-containing polymer comprises:

(I) a repeat unit derived from a monomer having a fluoroalkyl group, and (II) a repeat unit derived from a fluorine-free monomer, and/or (III) a repeat unit derived from a crosslinkable monomer.

2. The method according to claim 1, wherein the repeat unit (II) is derived from a fluorine-free olefinically unsaturated monomer of the formula (II-A):

$$CH_2{=}CR^{21}C({=}O){-}O{-}CH_2{-}CR^{22}H{-}R^{23} \quad \text{(II-A)}$$

or the formula (II-B):

$$CH_2{=}CR^{21}C({=}O){-}O{-}R^{23} \quad \text{(II-B)}$$

wherein $R^{21}$ is $CH_3$ or H, $R^{22}$ is $CH_3$ or $C_2H_5$, and $R^{23}$ is $C_nH_{2n+}$(n=1 to 30).

3. The method according to claim 2, wherein, in the fluorine-containing polymer, the amount of the repeat unit (II-A) is from 5 to 75 parts by weight and the amount of (II-B) is from 0 to 50, based on 100 parts by weight of the repeat unit (I).

4. The method according to claim 1, wherein the urethane compound (B) is a fluorine-containing compound or a fluorine-free compound.

5. The method according to claim 1, wherein the urethane compound (B) is a compound of the formula:

$$(Rf{-}CONH)_aX(NH{-}CO{-}R')_b$$

wherein Rf' is a monovalent organic group having at least one fluorine atom,

X is an organic group having a valency of (a+b) remaining after all isocyanate groups are removed from an isocyanate compound having (a+b) isocyanate groups, R' is a monovalent organic group free of a fluorine atom, and a is an integer of 0 to 10, b is an integer of from 0 to 10, and the total of a and b is an integer of 1 to 15.

6. The method according to claim 1, wherein the pH of the treatment liquid is adjusted to at most 4 in the step (2).

7. The method according to claim 1, wherein the water- and oil-repellent agent further comprises (C) a silicon-containing compound selected from the group consisting of silicone oils and silicone resins.

8. The method according to claim 2, wherein n=1 to 6.

9. The method according to claim 1, wherein the fluorine-containing polymer comprises:

(I) a repeat unit derived from a monomer having a fluoroalkyl group, and (II) a repeat unit derived from a fluorine-free monomer.

10. The method according to claim 1, wherein the fluorine-containing polymer comprises:

(I) a repeat unit derived from a monomer having a fluoroalkyl group, (II) a repeat unit derived from a fluorine-free monomer, and (III) a repeat unit derived from a crosslinkable monomer.

11. A textile obtained by the method according to claim 1.

12. A carpet obtained by the method according to claim 1.

13. The carpet according to claim 12, wherein the carpet comprises a fiber selected from the group consisting of a nylon fiber, a propylene fiber and a polyester fiber.

14. A water- and oil-repellent agent usable in a method of preparing a treated textile, comprising steps of:

(1) preparing a treatment liquid comprising a water- and oil-repellent agent, (2) adjusting pH of the treatment liquid to at most 7, (3) applying the treatment liquid to a textile, (4) treating the textile with steam, and (5) washing the textile with water and dehydrating the textile, wherein the water- and oil-repellent agent comprises (A) a fluorine-containing compound which is a fluorine-containing polymer and (B) a urethane compound, wherein the fluorine-containing polymer comprises:

(I) a repeat unit derived from a monomer having a fluoroalkyl group, and (II) a repeat unit derived from a fluorine-free monomer, and/or (III) a repeat unit derived from a crosslinkable monomer.

15. The water- and oil-repellent agent according to claim 14, wherein the water- and oil-repellent agent further comprises (C) a silicon-containing compound selected from the group consisting of silicone oil and silicone resin.

16. The water- and oil-repellent agent according to claim 14, wherein the fluorine-containing polymer comprises:

(I) a repeat unit derived from a monomer having a fluoroalkyl group, and (II) a repeat unit derived from a fluorine-free monomer.

17. The water- and oil-repellent agent according to claim 14, wherein the fluorine-containing polymer comprises:

(I) a repeat unit derived from a monomer having a fluoroalkyl group, (II) a repeat unit derived from a fluorine-free monomer, and (III) a repeat unit derived from a crosslinkable monomer.

* * * * *